US006407271B1

(12) United States Patent
Deffense

(10) Patent No.: US 6,407,271 B1
(45) Date of Patent: Jun. 18, 2002

(54) METHOD FOR ELIMINATING METALS FROM FATTY SUBSTANCES AND GUMS ASSOCIATED WITH SAID METALS

(76) Inventor: Etienne Deffense, Terre l'Oreye 21, Charleroi B-6032 (BE)

( * ) Notice: Subject to any disclaimer, the term of this patent is extended or adjusted under 35 U.S.C. 154(b) by 0 days.

(21) Appl. No.: 09/462,423

(22) PCT Filed: Jul. 9, 1998

(86) PCT No.: PCT/BE98/00107

§ 371 (c)(1),
(2), (4) Date: Feb. 11, 2000

(87) PCT Pub. No.: WO99/02630

PCT Pub. Date: Jan. 21, 1999

(30) Foreign Application Priority Data

Jul. 9, 1997 (BE) ..... 9700597

(51) Int. Cl.[7] ..... C11B 3/00

(52) U.S. Cl. ..... 554/200; 554/195; 554/198; 554/199

(58) Field of Search ..... 554/184, 190, 554/200, 83, 198, 199, 195

(56) References Cited

U.S. PATENT DOCUMENTS 4,049,686 A 9/1977 Ringers et al. ..... 260/424
4,698,185 A 10/1987 Dijkstra et al. ..... 260/403
4,944,954 A * 7/1990 Strop et al. ..... 426/417
6,015,915 A 1/2000 Jamil et al. ..... 554/184

FOREIGN PATENT DOCUMENTS

| | | | |
|---|---|---|---|
| EP | 0 507 363 A1 | | 10/1992 |
| FR | 0 388 567 | | 6/1965 |
| GB | 687 843 | | 1/1949 |
| WO | 95/00609 | * | 1/1995 |

OTHER PUBLICATIONS

Pryor et al, US patent 4877765, AN 89:89188 USPATFULL, see abs and citation, Oct. 1989.*

* cited by examiner

*Primary Examiner*—Deborah D. Carr
(74) *Attorney, Agent, or Firm*—Morgan, Lewis & Bockius LLP

(57) ABSTRACT

The invention relates to a process for removing phospholipids and/or polyvalent metals from a fatty substance. The process comprises the step of mixing by mechanical emulsification an aqueous solution of a salt of a polycarboxylic acid in the fatty substance. The mixture is present in the form of fine droplets or micelles of said aqueous phase in the fatty substance. The aqueous phase contains also advantageously an electrolyte derived from a monovalent cation. The preferred polycarboxylic acid salt is tetrasodium EDTA which is a complexant.

16 Claims, No Drawings

METHOD FOR ELIMINATING METALS FROM FATTY SUBSTANCES AND GUMS ASSOCIATED WITH SAID METALS

The oxidation of polyunsaturated fatty substances constitutes a crucial problem as it modifies the quality of the oil and results in a bad taste of the oil, an unpleasant odour and a change of color.

Among the various reasons for the degradation of the oils, the presence of metals such as copper and iron have been recognized. These metals act indeed as powerful pro-oxidant.

It is therefore very important to eliminate the metals from the fatty substances. The metals are essentially present in the form of ions bound to phospholipids, which are themselves to be eliminated, such metals being typically iron, calcium and magnesium. These resulting salts are soluble complexes of phosphatidic acids and phosphatidylethanolamine. These complexes, also called nonhydratable phospholipids, are difficult to remove and traditional degumming is not sufficient for reducing the concentration below an acceptable level.

Numerous patents or patent applications are directed to processes for elimination of such non hydratable phospholipids.

U.S. Pat. Nos. 4,069,686 and 4,698,185 are typical examples. Phospholipids content may be reduced to around 20 ppm and iron content to 0.2 ppm. However these concentrations are still too high.

French patent 1,388,567 and PCT application WO 95/00609 disclose the refining of oil by using organic acids and emulsifiers. The fatty substance is in suspension in an aqueous phase containing the acid and the emulsifier. Phospholipids are eliminated as a result of complexation of polyvalent metals by acids, preferably polycarboxylic acids.

The presence of emulsifiers necessitates however further operations consisting for example in washings with centrifugation. On the other hand, the preferred emulsifiers, for example sodium laurylsulfate (SDS), is not allowed in some countries due to the difficulty of eliminating them at the refining step.

The purpose of the present invention is to overcome the mentioned disadvantages and to provide an economically valuable process for eliminating completely metals such as calcium, magnesium, iron from fatty substances, animal or vegetable fat, crude or delecithinated. After separation of the aqueous phase, the iron content is indeed brought down to 8 to 0.05 ppm. Also the phosphorous content originally ranging from 800 to 100 ppm may be reduced to less than 5 ppm even for poor quality oils.

According to the present invention, there is provided a process for removing phospholipids and/or polyvalent metals from a fatty substance comprising the step of mixing the fatty substance with an aqueous solution of a salt of polycarboxylic acid characterised in that the mixture is operated in such a way to form only , or essentially only, fine droplets or micelles of said aqueous phase in the fatty substances. No detergent or emulsifier is added previously or simultaneously to the mixing step.

The elimination of metals and bound phospholipids is achieved by intimate mixing of an aqueous solution containing a polycarboxylic complexing agent in the forms of droplets, emulsion or micelles in an excess of the oil to be refined.

The complexing agent is preferably an acid comprising at least 3 carboxylic functionalities, in the acid form or in the form of salts of monovalent cations. The preferred complexing agent is a sodium salt of ethylenediaminetetraacetic acid (EDTA). A potassium salt or a mixed salt may also be appropriate.

The sodium EDTA salts solution used in the process may also be a mixture of sodium EDTA salt with any other inorganic base.

According to one embodiment of the invention, the fatty substance containing a high proportion of non hydratable phospholipids is first intimately mixed with an organic or inorganic acid in such a way to dissociate the phospholipid-metal complexes and to facilitate the complexation of the metals with a aqueous solution of sodium EDTA intimately mixed to the oil. Simultaneously, the sodium EDTA solution neutralizes the free hydroxyl functionalities of phosphatidic acid (P.A.) and of phosphatidylethanolamine (P.E.) in order to make them hydratable as sodium salts.

The preferred organic acid used to dissociate the phospholipid-metal complex is selected from the group consisting of citric acid, malic acid, ethylenediaminetetraacetic acid, tartric acid, oxalic acid, maleic acid or an inorganic acid such as phosphoric, hydrochloric or sulfuric acid.

The concentrated acid is added in low quantities to the fatty substances. If it is added as a concentrate, the amount of acid may vary from 0.005 to 0.15% by weight relative to the oil. However it may be diluted up to 90%. This pretreatment with an acid is advantageously achieved at the same temperature than the one of the addition of the complexing agent water solution. In some cases, a different temperature is chosen.

According to the above embodiment, the acid is mixed for a very short time, typically 3–4 seconds to 10 minutes, with a high-shear mixer or a homogenizer. It may also be mixed with a traditional stirrer for more than 10 minutes.

Preferably, the aqueous solution of complexing agent comprises also an electrolyte derived from monovalent cations for example NaCl, KCl or Na2SO4. The concentration of the electrolyte will vary preferably between 0.1% and 10%, typically between 0.5 and 5 % by weight.

The amount of complexing agent is near the equivalent stoichiometric amount of the estimated amount of metals in the oil to be refined.

The EDTA salt chelates efficiently the metallic polyvalent cations ($F^{++}$, $Fe^{+++}$, $Ca^{++}$, $Mg^{++}$) and forms with the latter far more stable complexes than the ones obtained with phosphatidic acid or even phosphoric or citric acids which have a lower stability constant. Consequently, the nonhydratable phospholipid-metal complex ($M=FE^{++}$, $Ca^{++}$, $Mg^{++}$) is rapidly displaced by the sodium salt of EDTA in order to provide on one part a new hydratable EDTA-M complex and on the other part an hydratable sodium phospholipid salt. The EDTA complex is very stable, even at high temperature. The separation of the aqueous phase may then be achieved at an higher temperature by decantation or centrifugation, with consequential low losses in neutral oils and a high separation capacity.

The oils containing a high proportion of metals and phospholipids treated in that way may be bleached in a classical way with equivalent amounts of earth than the ones necessary in the chemical refining process and may be physically refined in order to generate oils of better quality as regards resistance to oxydation, and this at competitive prices.

The elimination of metals and phospholipids in accordance with the invention may be easily achieved at the location of extraction, for example in the palm oil mill, where the sludge oils are eliminated and so produce an oil which require only one stage of deacidification-deodorisation by steam stripping. The invention provides therefore a substantial economical advantage.

The intimate mixture of "aqueous phase in oil" is obtained for example by using a high-shear mixer or homogenizer of the Ultraturax type between 50 and 20,000 rpm or by using a ultrasonic device. Typically the aqueous solution is between, 0,5 to 30% by weight, preferably 3 to 15%, more preferably 5 to 10% by weight of the fatty substance to refine. The latter has most often already been degummed in a classical way for removing the hydratable phospholipids by delecithination, that is to say by stirring in hot water and centrifugation.

The reaction is preferably performed at a temperature varying from 5 to 120° C., more preferably around 80° C.

The reaction time will depend on the temperature. The reaction may take a few seconds, a few minutes or more than one hour.

As already mentioned, the preferred chelating (complexing) agent is ethylenediaminetetraacetic acid or one of the corresponding sodium, potassium or ammonium salt. This acid will preferably be in the di-sodium, tri-sodium or tetra-sodium form.

As already mentioned, the amount of complexing agent in the aqueous phase is chosen by taking into account the estimated amount of metals to be removed and the presence of free carboxylic acids in the oil to be refined, as well as the nature and the form of the complexing agent. This amount is advantageously around the stoichiometric amount, varying from 1 to 2, preferably 1.2 to 1.5 equivalent. For example for the tetrasodium salt of EDTA and a vegetable oil already degummed using a traditional method, there must be taken into account the fact that the free carboxylic acids will react first with the tetrasodium EDTA salt to provide the corresponding salt and tri-sodium EDTA. The latter will then complex the metals bound to the phospholipids.

According to one aspect of the invention, the fish oils and the rapeseed oils which contain large amounts of metals phospholipids and sulphur compounds may be desulphurised simultaneously to the process of the invention.

According still another aspect of the invention, the crude maize and sunflower oils with high iron, phospholipids and wax contents may be dewaxed simultaneously with the present process. After intimate mixing of the aqueous phase with the crude oil, the suspension is cooled under weaker stirring between 5 and 90° C., preferably, 5 and 50° C., before centrifugation. There is obtained in that way a purified wax-free oil with a iron content lower than 0.05 ppm, and the phosphorous content is lower than 5 ppm. Advantageously, an emulsifier may be added to the initial mixture during the cooling process.

Analogously, a palm oil may be treated by an aqueous solution containing the same reactants, then cooled progressively in a cristalliser before centrifugation. A light phase appears, comprising palm olein from which metals, phospholipids and glycolipids have been removed, and a heavy phase, containing stearin cristals surrounded by the aqueous phase.

The latter phase is heated and centrifuged in order to provide palm stearin also without metals, phospholipids and glycolipids. Using such process, palm oil may be degummed, demetallised and fractioned in one and the same operation.

The process of the invention allows the physical refining of oils with phosphorous content lower than 50 ppm or even lower than 20 ppm, without addition of bleaching earth or with an amount of earth lower than 0,5%, in order to provide an oil of maximum red 3 (Lovibond 5¼") in the case of palm oil.

More particularly, the palm oil will more efficiently cristallise, will be more easily fractioned and the yield will be higher.

Waxes are easily partially or completely removed from crude or delecithinated oils.

The invention is further illustrated by the following non-limitative examples

EXAMPLE 1

50 kg of delecithinated soybean oil with a phosphorous content of 190 ppm is heated at 80° C. in a 100 liter reactor provided with an Ultra-Turax high-shear mixture of the UTC T 115/4 type. The aqueous phase, containing 2,5 liters of water at 80° C. in which 100 g of disodium salt of EDTA and 50 g of sodium chloride are dissolved, is added in one portion to the soybean oil. After a stirring period of 10 minutes, the aqueous phase is centrifuged.

| | starting oil | after treatment |
|---|---|---|
| Ca (ppm) | 80 | 0.8 |
| Mg (ppm) | 62 | 0.7 |
| Fe (ppm) | 2 | 0.03 |
| Phosphorous (ppm) | 190 | 3 |

EXAMPLE 2

50 kg of cocoa oil with a phosphorous content of 80 ppm, are heated to 80° C. in a 100 liters reactor provided with a Ultra-Turax high-shear mixer of the UTC T 115/4 type. The aqueous phase, containing 5 liters of water at 80° C. where 70 g of disodium salt of EDTA and 100 g of sodium chloride are dissolved, is added in one portion to the cocoa butter. After a stirring period of 8 minutes, the aqueous phase is centrifuged.

| | starting oil | after treatment |
|---|---|---|
| Ca (ppm) | 5 | 0.04 |
| Phosphorous (ppm) | 80 | 2 |

EXAMPLE 3

50 kg of crude sunflower oil with a phosphorous content of 95 ppm, are heated to 95° C. in a 100 liter reactor provided with a Ultra-Turax high-shear mixer of the UTC T 115/4 type. The aqueous phase, containing 5 liters of water at 90° C. where 100 g of tetrasodium salt of EDTA and 50 g of sodium sulfate are dissolved, is added in one portion to the sunflower oil. After a stirring period of 10 minutes, the mixture is cooled with moderate stirring, heated rapidly to 20° C., then centrifuged in order to yield an oil with a "cold test" at 0° C. of 24 hours.

| | starting oil | after treatment |
|---|---|---|
| Fe (ppm) | 2.1 | 0.03 |
| Phosphorous (ppm) | 95 | 2.5 |

EXAMPLE 4

50 kg of crude palm with an acidity of 3.8% are heated to 90° C. in a 100 liter reactor provided with a Ultra-Turax high-shear mixer of the UTC T 115/4 type. The aqueous phase, containing 5 liters of water at 90° C. where 50 g of tetrasodium salt of EDTA and 50 g of sodium sulfate are dissolved, is added in one portion to the palm oil. The mixture is intimately dispersed in the palm oil for 10 minutes then centrifuged.

| | starting oil | after treatment |
|---|---|---|
| Fe (ppm) | 4.5 | 0.05 |
| Phosphorous (ppm) | 20 | 1.5 |

EXAMPLE 5

50 kg of delecithinated soybean oil with a phosphorous content of 190 ppm, are heated to 95° C. in a 100 liter reactor provided with a Ultra-Turax high-shear mixer of the UTC T 115/4 type. There is added 0.1% by weight of 85° C. phosphoric acid (50 g) which is intimately mixed for 10 minutes at 90° C. There is then added in one portion, at 90° C., 5 liters of an aqueous phase, containing 200 g of tetrasodium salt of EDTA and 50 g of sodium sulfate are dissolved, is added in one portion to the sunflower oil. After a stirring period of 10 minutes, the aqueous phase is centrifuged.

| | starting oil | after treatment |
|---|---|---|
| Fe (ppm) | 2 | 0.04 |
| Phosphorous (ppm) | 190 | 2.1 |

In summary the invention provides a process for removing phospholipids and/or polyvalent metals from a fatty substance comprising the step of mixing by mechanical emulsification an aqueous solution of a salt of a polycarboxylic acid in the fatty substance characterised in that the mixture is essentially present in the form of fine droplets or micelles of said aqueous phase in the fatty substance, preferably without previous or simultaneous addition of an emusifier. The preferred salt of polycarboxylic acid is a salt of ethylenediaminetetraacetic acid.

The process preferably comprises also a centrifugation or ultrafiltration step operated after the mixing step. A detergent or an emulsifier may be added after the mixing step.

According to a particular aspect the mixture of an aqueous solution with the fatty substance is cooled between 15 and 40° C. before a separation step by ultrafiltration or centrifugation in order to provide an olein and an aqueous phase surrounding a stearin, said aqueous phase being able to provide after a further separation a stearin, said olein and said stearin being in that way separated and both having, for example, a iron content of less than 50 ppb and a phosphorous content of less than 4 ppm. A detergent of the sodium laurylsulfate type is advantageously added before the separation step.

The process may be operated in direct association with the removal of sludge oils, in a mill for crude palm oil.

The fatty substance may be previously pre-treated with an acid, said acid being a organic or inorganic acid in an aqueous solution, the amount of acid varying preferably between 0.005 to 0.15% in weight relative to the fatty substance.

The invention provides also a process for removing phospholipids and/or polyvalent metals from a fatty substance comprising the step of mixing ethylenediaminetetraacetic acid with the fatty substance and a further step of mixing an aqueous solution of a sodium or potassium base, the resulting mixture being essentially present in the form of fine droplets or micelles of said aqueous phase in the fatty substance, said process being otherwise in accordance with any compatible features of the above described process.

It is to be understood that changes and variations may be made without departing from the spirit or scope of the following claims.

I claim:

1. A process for removing phospholipids and/or polyvalent metals from a vegetable oil comprising the steps of mixing by mechanical emulsification an aqueous solution of a salt of a polycarboxylic acid in said vegetable oil in order to provide a mixture wherein said resulting mixture is essentially present in the form of fine droplets or micelles of said aqueous phase in said vegetable oil, the weight ratio vegetable oil/aqueous solution being above 3 centrifuging or ultrafiltrating the resulting mixture in order to separate the aqueous phase from the vegetable oil.

2. A process according to claim 1 wherein the step of mixing is operated without previous or simultaneous addition of an emusifier.

3. A process according to claim 1 wherein the salt of polycarboxylic acid is a salt of ethylenediaminetetraacetic acid.

4. A process according to claim 1 wherein the salt is the tetrasodium salt of ethylenediaminetetraacetic acid.

5. A process according to claim 1 wherein the salt is the disodium or trisodium salt of ethylenediaminetetraacetic acid.

6. A process according to claim 1 wherein the salt of the polycarboxylic acid is present at a concentration of 0.01 to 2% by weight relative to the said vegetable oil.

7. A process according to claim 1 wherein the aqueous solution comprises also 0.01 to 5% by weight of a monovalent cation electrolyte.

8. A process according to claim 1 wherein the aqueous solution comprises also 0.01 to 5% by weight of a monovalent cation electrolyte selected from the group comprising sodium chloride, potassium chloride, ammonium chloride, sodium sulphate, potassium sulphate, aluminium sulphate and ammonium sulphate.

9. A process according to claim 1 wherein the temperature of the mixture ranges from 20° C. to 98° C.

10. A process according to claim 1 in that the mixing operation is performed for a period ranging from 3 seconds to 60 minutes.

11. A process according to claim 1 wherein the mixture of the aqueous phase in the fatty su stance is obtained by dispersion with a high-shear mixer operating between 50 and 12,000 rpm.

12. A process according to claim 1 wherein the mixing operation is followed by an additional mechanical stirring for 15 minutes to 2 hours.

13. A process according to claim 1 wherein the vegetable oil is selected from the group comprising soybean oil, cocoa butter, sunflower oil, palm oil, rapeseed oil, each in crude or delecithinated form.

14. A process according to claim 1 wherein the weight ratio vegetable oil/aqueous solution is above 5.

15. A process for removing phospholipids and/or polyvalent metals from a vegetable oil comprising the step of mixing ethylenediaminetetraacetic acid with the vegetable oil mixing the resulting composition with an aqueous solution of a sodium or potassium base, under such conditions that the overall resulting mixture is essentially present in the form of fine droplets or micelles of said aqueous phase in the vegetable oil, the weight ratio vegetable oil/aqueous solution being above 3 centrifuging or ultrafiltrating the resulting mixture in order to separate the aqueous phase from the vegetable oil.

16. A process according to claim 1 in that the mixing operation is performed for a period ranging from 5 minutes to 15 minutes.

* * * * *